US006017583A

United States Patent [19]

Gass

[11] Patent Number: 6,017,583

[45] Date of Patent: Jan. 25, 2000

[54] PROCESS FOR THE PRODUCTION OF A WEB OF MATERIAL

[75] Inventor: Michael Gass, Derendingen, Switzerland

[73] Assignee: Conrad Munzinger & Cie AG, Switzerland

[21] Appl. No.: 08/913,809

[22] PCT Filed: Jan. 17, 1997

[86] PCT No.: PCT/EP97/00214

§ 371 Date: Sep. 24, 1997

§ 102(e) Date: Sep. 24, 1997

[87] PCT Pub. No.: WO97/27361

PCT Pub. Date: Jul. 31, 1997

[30] Foreign Application Priority Data

Jan. 25, 1996 [EP] European Pat. Off. ..... 96101070

[51] Int. Cl.[7] ..... B05D 3/10

[52] U.S. Cl. ..... 427/201; 427/352; 427/353; 427/366; 210/504; 210/507

[58] Field of Search ..... 427/201, 202, 427/352, 353, 365, 366; 210/504, 507; 264/45.4, 45.8, 46.2, 216

[56] References Cited

U.S. PATENT DOCUMENTS

| | | | |
|---|---|---|---|
| 4,482,601 | 11/1984 | Hartigan, Jr. | 428/234 |
| 5,298,124 | 3/1994 | Eklund et al. | 162/306 |
| 5,364,504 | 11/1994 | Smurkashi et al. | 162/116 |

FOREIGN PATENT DOCUMENTS

| | | |
|---|---|---|
| 037387 | 7/1988 | European Pat. Off. . |
| 342171 | 11/1989 | European Pat. Off. . |
| 187967 | 3/1990 | European Pat. Off. . |
| 187967 | 7/1990 | European Pat. Off. . |
| 273613 | 2/1992 | European Pat. Off. . |
| 196045 | 7/1992 | European Pat. Off. . |
| 653512 | 5/1995 | European Pat. Off. . |
| 3419708 | 10/1993 | Germany . |
| 8605219 | 9/1986 | WIPO . |
| 86/05219 | 12/1986 | WIPO . |
| 9114558 | 3/1991 | WIPO . |
| 9521285 | 8/1995 | WIPO . |

*Primary Examiner*—Fred J. Parker
*Attorney, Agent, or Firm*—Liniak, Berenato, Longacre & White, LLC

[57] ABSTRACT

In a process for the manufacture of a strip material (1) a plastics layer (5, 6) is formed at least on one side of a support (2) from a mixture of plastics materials and particulate soluble corpuscles wherein the soluble corpuscles are leachable by a solvent of a type against which the plastics material is stable. Thereafter the soluble corpuscles are leached out from the plastics layer (5, 6) with the formation of through-flow passages. According to the invention, a plastics powder is prepared as the plastics material, which is mixed with the soluble corpuscles and applied onto the support (2). By heat and pressure treatment a plastics layer (5, 6) including therein the soluble particles, is produced from the mixture of plastics powder and soluble corpuscles, prior to the soluble corpuscles being leached at least in part out of the plastics layer (5, 6).

32 Claims, 1 Drawing Sheet

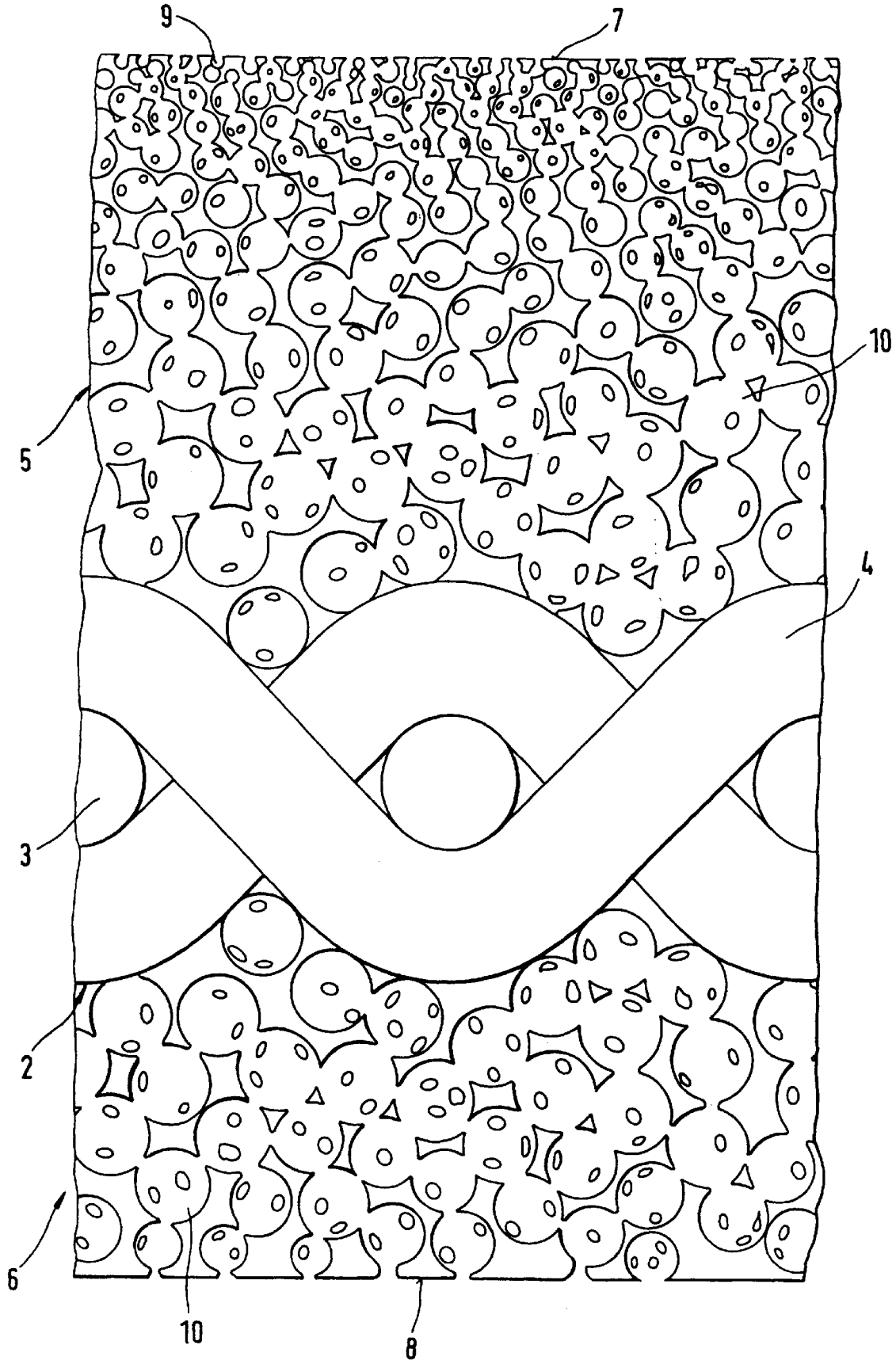
9
7
10
5
4
3
2
6
10
8

PROCESS FOR THE PRODUCTION OF A WEB OF MATERIAL

FIELD OF THE INVENTION

The invention relates to a process for the manufacture of a strip material in which on at least one side of a support a plastics layer is formed from a mixture of plastics material and particulate soluble corpuscles, the soluble corpuscles being leachable by a solvent to which the plastics material is stable and that thereafter the soluble corpuscles are at least in part leached out of the plastics layer with the formation of throughflow passages.

DESCRIPTION OF RELATED ART

A strip material of the aforesaid type for employment in a paper machine is described in EP-B-0 196 045. It comprises a support in the form of a liquid previous fabric onto which a layer, 1,3 to 5 mm thick, of an elastomeric Polymer resin has been applied. The plastics layer comprises throughflow passages which pass from the otherwise smooth and plane outside down to the support and which, in the paper machine, serve as de-watering passages.

The production of the throughflow passages is brought about in that textile fibres are homogeneously dispersed in the polymer resin, prior to the mixture of textile fibres and polymer resin being applied onto the support. As an alternative to the aforegoing, a fibre fleece may first be applied onto the support, whereafter the coating of polymer resin is applied. In both cases the textile fibres are composed of an organic material which can be dissolved by the application of a solvent, the plastics layer being resistant to this solvent. The leaching out of the textile fibres is carried out after the application of the polymer resin by the application of the solvent such that the throughflow passages are formed the configuration and orientation of which corresponds to the leached out textile fibres.

In a less preferred embodiment, particulate corpuscles are proposed instead of the textile fibres which are distributed homogeneously in the polymer resin. Inorganic salts or their hydrate or oxides are proposed as the material for those corpuscles. By appropriate solvents they can be leached out of the polymer resin in the same manner as the textile fibres and in the course thereof leave behind pore cavities.

In the manufacture of the above described paper machine belt difficulties are experienced with the uniform distribution of the soluble components—either fibres or particulate corpuscles—in the polymer resin and with the maintenance of this distribution when applying the mixture. The reason is that during the processing of the mixture of polymer resin and soluble components demixing takes place, so that there can be no certainty that throughflow passages are formed by the leaching out of the particles. For that reason it is also not possible to produce distributions of the soluble components which vary over the cross-section.

Apart from that, polymer resins have a tendency after curing to form a closed surface which inhibits the dissolving out of the soluble textile fibres or corpuscles contained in the polymer resin. In order to solve this problem, it has been proposed in EP-B-EPO 273 613 to so grind down the surface of the plastics layer, that a communication is formed to the soluble fibres and in addition a smooth surface is generated. Such a grinding procedure, however, is very time consuming. Moreover, it is first necessary to apply an appropriate excess of plastics material and during the grinding procedure dust is formed which must be sucked off and be either disposed of or be processed for reuse. Moreover, a smooth surface is formed which inhibits release of the paper strip from the paper machine belt. The reason is that paper strips are inclined to become firmly drawn against smooth surfaces.

Apart from the aforegoing disadvantages, paper machine belts of this genus are claimed to have a number of advantages as compared with known felt materials, according to the batt-on-base principle, more particularly an increased resistance against permanent deformation and thereby a longer operating life and resulting therefrom reduced maintenance costs, improved abrasion resistance and higher structural strength, lower affinity for contaminating substances as well as more uniform pressure distribution and thus improved de-watering characteristics.

The aforedescribed development was preceded by a proposal to embed in the fibres of a paper machine felt fibres or particles which can be leached out by means of a solvent in relation to which the remaining fibres and the support of the paper machine belt are solvent resistant, i.e. stable (DE-C-34 19 7 or 8). The manufacture proceeds such that a non-woven fibre web of insoluble fibres and soluble components is formed and is needle-bonded onto the support and that thereafter the paper machine belt is compacted with pressure and heat. In the course thereof, the soluble components may melt together. Due to the resolution of the soluble components, pore cavities are formed which, in spite of the previous compression and the thereby generated high density, provide the paper machine belt with the void volume required for de-watering.

It is a disadvantage of this solution that, in spite of the compression, the durability is considerably less than with plastics coated supports. Moreover, the conventional machines for this purpose, in particular weaving looms and needling machines, cannot be dispensed with.

There has been no lack of attempts to manufacture the paper machine belts comprising a plastics layer with a support and throughflow passages passing there through in a different manner. Thus in EP-B-0 037 387 a strip material is proposed in which the throughflow passages are produced by perforating a previously applied plastics foil by means of a laser apparatus. Apart from the fact that the throughflow passages do not intercommunicate, for which reason a gas or water permeation transversely to the plane of the strip material cannot take place, the manufacture of such strip is moreover exceedingly expensive, in particular if major surface areas have to be processed by means of a laser device, as is the case with paper machine belts. Moreover, foils of the required width and having adequate uniformity cannot be produced.

It is proposed in WO 91/14558 to produce the throughflow passages in that onto the non-cured plastics layer a perforated mask is applied which is then radiated. Due to this radiation, the plastics material is cured fully in the region of the perforations of the mask. After removing the perforated mask the plastics material which then has not yet been cured is removed by compressed air. This process as well is expensive and leaves behind relatively large free surface areas and for that reason cannot be applied universally. Moreover, here as well waste material which has to be disposed of or recycled is formed.

A different concept was adopted in accordance with the proposal according to EP-B-0 187 967. In this case, in the context of a paper machine belt, a porous plastics layer on a support is created in that loose particles of a synthetic polymeric polymer resin of the order of magnitude of 0,15 to 5 mm are distributed on the surface of a support web and are then subjected to thermal treatment in which the polymer resin particles are heated above the softening point, whereby they are fused together and to the support fabric at their contact localities. Instead or in combination therewith it is also possible to provide for the application of a resin-like binder. lnstead of the particles, it is also possible to distribute loose fibres on the support fabric. After the adhesion of the particles or fibres to one another and to the support fabric, cavities remain which render the plastics layer liquid pervious.

Something similar is proposed in accordance with EP-A-0 653 512 except that in this case the material strip is initially produced exclusively from polymer particles which, by heat action, are inter-bonded at their contact localities. If required, a strengthening structure in the form of a reinforcing may be totally embedded in the belt thus formed. This may take the form of a pure fibre product or a fabric. The particles may also have different diameters in order to generate a permeability which increases towards the other side.

The disadvantage of strip materials produced according to this principle resides in that it is very difficult to produce them in a reproducible manner, in particular as regards permeability. Moreover, their surface is very uneven for which reason the simultaneous application of pressure and heat—wherever the particles are formed of fine fibres (EP-B-0 187 967)—or a grinding procedure (EP-A-0 653 512) are proposed for the purpose of rendering the surface even.

According to WO 95/21285 a polymer coating is applied by means of a transfer foil with the simultaneous application of heat and pressure onto a support in which context the polymer film due to the heat action is transformed on the transfer foil to coherent droplets with free spaces formed inbetween, as a result of which the plastics layer applied onto the support is porous. In this process as well, it is difficult to adjust the permeability of the plastics layer in a reproducible manner and to adapt it to whatever requirements are needed. Moreover, foils of the width required for that purpose are not available and would also not be producible with adequate uniformity.

BRIEF SUMMARY OF THE INVENTION

The invention is based on the object to provide a process for the manufacture of a strip material of the type aforesaid by means of which a desired distribution of the soluble corpuscles within the plastics layer can be attained. A further object resides in so designing the process that the soluble corpuscles may be leached out of the plastics layer in a simple manner.

This object is attained according to the invention in that, as the plastics material, a plastics powder is prepared which is mixed with the soluble corpuscles and applied onto the support and that, by heat and pressure treatment, from the mixture of plastics powder and soluble corpuscles a plastics layer with the soluble corpuscles contained therein is produced before the soluble corpuscles are at least partly leached out of the plastics layer.

By first producing a pulverulent mixture, an extraordinarily uniform distribution of the soluble particles within the plastics material may be attained. This distribution does not change either during or after the application of the powder. The reason is that the plastics powder becomes electrostatically charged in such a manner that the mixed powder corpuscles of plastics and soluble corpuscles adhere to one another and therefore do not change in position. Accordingly, demixing problems do not arise. The subsequent thermal treatment (sintering) causes a continuous plastics layer to be formed from the powder layer. In the course thereof, the plastics powder is plastified to such an extent that a homogeneous plastics layer is formed, i.e. a plastics layer which apart from the soluble corpuscles is substantially non-porous and which adheres to the support. This effect is supported by the pressure treatment which moreover takes care of a plane exposed surface. This thermal treatment may take place in a heating oven or under infrared radiators. The pressure treatment may subsequently be carried out in a calender or the like.

The particle size of the corpuscles of the plastics powder and also that of the soluble corpuscles as well as their mixing ratio may be adjusted within wide limits depending on requirements for a desired structure of the plastics layer to result, in particular as regards the cavities of the throughflow passages resulting from the leaching of the soluble corpuscles. Preferably, the soluble corpuscles should have a mean diameter of 30 to 500 $\mu$m. The mean particle size of the plastics powder should be less than that of the soluble corpuscles, for example amounting to only one half to one third that of the soluble corpuscles and in no circumstances more than 100 $\mu$m. In this manner, the soluble corpuscles are virtually jacketed by a plurality and possibly even a multitude of corpuscles of the plastics powder and a comparatively dense packing result.

The volume ratio between the plastics powder and the soluble corpuscles advantageously is to be so adjusted that the soluble corpuscles are at least partly in contact with one another, not only in the direction transversely to the plane of the plastics layer but also within the plane of the plastics layer so that also within the plane of the plastics layer open pores and thereby de-watering volumes are made available and thereby the water carrying capacity is improved.

The volume ratio between the plastics powder and the soluble corpuscles is advantageously within the range of from ¼:¾ and ½:½, preferably in the region of ⅔:⅓.

The plastics powder and the soluble corpuscles may also be applied in layers, there optionally being provided for the individual layers different particle sizes, materials and mixing ratios in order to allow for prevailing requirements. Thus the soluble corpuscles may increase in size in successive layers towards the support. Alternatively, or in combination with the aforegoing, it is also possible for the number of soluble corpuscles to increase in the direction towards the support from one layer to the next layer. Both expedients serve to increase the permeability in the direction towards the support, which is particularly desirable when using the material strip in the forming and pressing region of a paper machine.

According to the invention, it is further proposed that during or after the production of the plastics layer, soluble particles are applied onto the outside of the plastics layer and are then pressed into the plastics layer, these soluble particles being leachable by a solvent of a type in relation to which the plastics material is stable and that thereafter these soluble particles are leached out. By this procedure embossments are created on the outside of the plastics layer, increasing the roughness thereof, which is of particular advantage when employing the strip material as a paper machine belt. The reason is that thereby the tendency of the paper strip to adhere too strongly to the paper machine belt is counteracted without causing markings. The paper belt is released substantially more readily from the paper machine belt than in the case of previously known embodiments of the same genus as were known from EP-B-O 196 045 and EP-B-0 273 613. The indentations due to their distribution in relation to the orifices of the throughflow passages are of such small size that an adequate contact area with the paper strip remains in order to permit a uniform support and pressure transfer. The throughflow passages and the embossments result in a low remoistening of the paper strip.

The advantages of the surface of the plastics layer being roughened in accordance with the invention, is not, however, limited to the employment in paper machines. In filter media as well, a surface which is too smooth can result in the adhesion of the separated material being too strong whereby its stripping off is rendered difficult.

A further advantage of this manner of procedure also resides in that by the pressing in of the soluble particles, where the soluble corpuscles are present close to the surface on the outside, an intercommunication with these is brought about. After the leaching out of the soluble particles, the solvent has access to the soluble corpuscles which initially were trapped inside the plastics layer and as a result can cause these as well to be completely dissolved and removed. To that extent, the embossments subsequently serve as the orifices of the throughflow passages. Accordingly, the process replaces the grinding down treatment in accordance with EP-B-O 273 613.

It is particularly advantageous if the soluble particles are applied in such a density onto the plastics layer that the embossments remaining after their dissolution at least partly intercommunicate and communicate with the throughflow passages. This feature produces a favourable effect on the de-watering characteristics, particularly in the employment as a paper machine belt.

Preferably, the soluble particles should be pressed into the plastics layer at a temperature thereof at which the plastics layer has been softened as compared with its condition at room temperature. This may be brought about in that the soluble particles are applied and pressed in succession to the formation of the plastics layer whilst its temperature is still elevated. The impression can be produced by a calender treatment. Preferably the soluble particles should have a mean diameter of from 5 to 100 $\mu$m.

In order to simplify the process of leaching out the soluble corpuscles and the soluble particles, both should be made of the same material so that the leaching out can proceed in a single process step using a single solvent. Regarding the soluble corpuscles contained in the plastics layer, substances should be selected which, when subjected to heating during the formation of the plastics layer, substantially retain their shape. For thin purpose polymer corpuscles can be used having a higher heat resistance than the plastics matrix into which the soluble corpuscles have been embedded. Advantageously these conditions should also apply in respect of the soluble particles pressed into the exposed surface of the plastics layer. However, particularly suitable for this purpose are inorganic substances and more particularly water-soluble salts, such as NaCl, KCl and/or $CaCO_3$ as well as chlorides, carbonates and/or soluble sulphates of the alkaline or alkaline earth elements or metals as well as those other salts which are apparent from DE-C-34 19 708. Such soluble particles or corpuscles are not impaired by the heat treatment necessary for the formation of the plastics layer and are readily free-flowing and therefore suitable for sprinkling. Also suitable are organic substances, for example carbohydrates (sugar) or salts of organic acids such as citric acid, ascorbic acid etc. In addition an anti-oxidant should be added to the plastics powder.

A further aspect of the invention teaches that soluble corpuscles of at least two substances are used of which in each case one substance is leachable by a particular solvent to which the respective other substance(s) is/are resistant. This opens the possibility to initially leach out only one part of the soluble corpuscles and then after having installed the material strip and after a certain period of operation to leach out once or more times a group of further soluble corpuscles in order to restore the initial permeability of the material strip once the permeability has decreased in operation by choking up etc. This concept is already disclosed in principle in EP-A-0 303 798 and in EP-A-0 320 559 in which the employment of soluble fibres within a felt has been proposed. It stands to reason that these soluble corpuscles must be stable under the conditions of employment for which the strip material is intended, i.e. in the event of being employed as a paper machine belt, against the liquors or vapours derived from the paper strip. As an alternative to the aforegoing, it is also possible that the soluble corpuscles can be dissolved from the matrix only in a retarded manner and successively.

The invention further provides that on the opposite side of the support, a second plastics layer is formed having throughflow passages in the same manner as were formed on the first side. In this context, the number and/or size of the soluble corpuscles in the second plastics layer should increase in the direction facing away from the support, and the number and/or size of the soluble corpuscles, in the regions of both plastics layers where they adjoin the support, should be of equal magnitude. It stands to reason that different distributions are also possible if this should be appropriate for the intended employment. It stands to reason that the outside of the second plastics layer may likewise be provided with embossments produced by the pressing in of soluble particles in the above described manner.

The support of the material strip according to the invention has the object to lend configurational and structural strength to the material strip essentially alone, and, where applicable, to absorb longitudinal and transverse forces. In addition it is to be liquid pervious. For this purpose textile supports formed from filaments, for example non-woven filament webs, knitted, worsted or woven structures or combinations of such textile supports are particularly suitable. Depending on the field of employment and strength requirements, the support may be of single or multiple layer structure. In the case of a support fabric, any type of fabric can be considered, in particular those of a type known per se in the field of paper machine belts. Mono-filaments as well as multiple filaments of preferably thermoplastic synthetic resin materials can be employed for the filaments. The support may in the alternative or in combination with the aforegoing also comprise a spun-bonded fibre fleece and/or a stamped or extruded reticulated structure. It may in addition be provided with a fibre fleece so that it has felt-like characteristics.

Synthetic resins as known in particular from the field of paper machine belts and as referred to in the above mentioned documents are suitable as materials for the support. The selection of the synthetic resins may be adapted to the particular field of employment and the conditions there prevailing. In particular, synthetic resins should be selected which do not suffer deterioration in the manufacture of the resin layer and the thermal exposure connected therewith.

Suitable for the plastics layer are polyamides such as polyamide 4.6, 6, 6.6, 6.10, 6.12, 11 and 12, polyesters, polyphenylsulphite, polyetheretherketone, polyurethane, polysulfone, thermoplastic aromatic polyamides, polyphthalamides as well as polypropylene. However, other polymers and elastomeric plastics such as disclosed, for example in EP-B-0 196 045 and EP-B-0 273 613 may also be used. Mixtures of different synthetic resins may also be used, for example having different elasticities in which case the plastics layer may also be formed of layers composed of plastics having different elasticities. In this respect as well the selection of the synthetic resins and their elastic properties may be adapted to the particular field of employment.

BRIEF DESCRIPTION OF THE DRAWING

FIG. 1 is a cross-sectional view of a material strip according to a preferred implementation of the present invention.

DESCRIPTION OF THE PREFERRED EMBODIMENTS

In the drawing, the invention is further illustrated by way of a working example shown on a highly enlarged scale. It shows in cross-section a portion of a material strip 1. The material strip 1 comprises a support 2 in the form of a fabric having longitudinal filaments 3 and transverse filaments 4. On each of the upper and the underside of the support 2 a plastics layer 5, 6 is provided.

The first plastics layer 5 has been produced in accordance with the process of the invention in that a mixture of a plastics powder and soluble corpuscles has been sprinkled onto the support 2 and both jointly have been subjected to a thermal and pressure treatment. Due to this, a homogeneous plastics layer 5 including soluble corpuscles substantially uniformly distributed therein has been produced, the pressure treatment having resulted in a plane outer surface. Further soluble particles were then sprinkled onto the still heated and therefore plastically readily deformable exposed side 7 of the plastics layer 5 and subsequently pressed by means of pressure rollers or the like into the plastics layer 5. The lower plastics layer 6 was dealt with in an analogous fashion, in particular with regard to the treatment of its outside 8.

Thereafter, the material strip 1 was subjected to a treatment with a solvent for the soluble particles and corpuscles. During this treatment the soluble particles pressed into the exposed sides 7, 8 of the plastics layers 5, 6 were first leached out, leaving behind embossments—for example indicated by 9. These embossments 9, at least in part not only communicate with one another but also with the soluble corpuscles close to the outsides 7, 8 of the plastics layers 5, 6, so that the solvent can also reach those corpuscles and dissolve them. The dissolution results in the formation of pore cavities—as exemplified by 10—in the plastics layers 5, 6, having the configuration of the respectively leached out corpuscles and inter-communicating with one another. This provides a communication not only in a vertical direction but because of the uniform distribution of the soluble corpuscles, also in the horizontal direction. This provides a pore structure similar to an open pore plastics foam, the pore cavities coacting to form throughflow passages.

The pore cavities 10 of the plastics layer 5 on the upper side now increase in size from the region of the exposed side 7 towards the support 2. This may be brought about in that initially a mixture of plastics particles and relatively large soluble corpuscles and thereafter a further mixture of plastics powder and by comparison smaller soluble corpuscles is applied. In the case of the plastics layer 6 on the underside a plastics powder including even larger soluble corpuscles has been used so that the pore cavities 10 are larger than those of the plastics layer 3 on the upper side.

I claim:

1. Process for the manufacture of a permeable strip material (1), in which, on at least one side of a support (2) a plastic layer (5, 6) is produced from a mixture of plastic material and particulate soluble corpuscles, wherein the soluble corpuscles are leachable by a solvent to which the plastic material is stable and that thereafter the soluble corpuscles are leached out from the plastic layer (5, 6) at least in part, with the formation of throughflow passages from one side to the other of the plastic layer sufficient to permit dewatering to occur, characterized in that the plastic material is prepared in the form of a plastic powder which is mixed with the soluble corpuscles and applied onto the support (2) and that by heat and pressure treatment sufficient to form a planar outer surface plastic layer (5, 6) is formed from the mixture of plastic powder and soluble corpuscles with the soluble corpuscles being contained therein, prior to the soluble corpuscles at least in part being leached out of the plastic layer (5, 6).

2. Process according to claim 1, characterised in that the plastic powder and the soluble corpuscles are intermixed prior to their application onto the support (2).

3. Process according to claim 1, characterised in that the soluble corpuscles have a mean diameter of 30 to 500 $\mu$m.

4. Process according to claim 2, characterised in that the mean particle size of the plastic powder is less than that of the soluble corpuscles.

5. Process according to claim 4, characterised in that the mean particle size of the plastic powder does not exceed 100 $\mu$m.

6. Process according to claim 1, characterised in that the plastic powder and the soluble corpuscles are mixed in a volume ratio of from ¼:¾ and ½:½.

7. Process according to claim 1, characterised in that the plastic powder and the soluble corpuscles are applied in a plurality of layers.

8. Process according to claim 1, characterized in that said plastic layer comprises a plurality of layers and the soluble corpuscles increase in size from one layer to the next layer in the direction towards the support (2).

9. Process according to claim 1, characterized in that said plastic layer comprises a plurality of layers and the number of the soluble corpuscles increases from one layer to the next in the direction towards the support (2).

10. Process according to claim 1, characterised in that during or after the formation of the plastic layer (5, 6) soluble particles are applied onto the outside (7, 8) of the plastic layer (5, 6) and are then pressed into the plastic layer (5, 6), the soluble particles being leachable by a solvent against which the plastic material (1) is stable and that thereafter these soluble particles are leached out.

11. Process according to claim 10, characterized in that the soluble particles are applied onto the plastics layer (5, 6) in such density that embossments (9) are formed after the leaching out and at least in part communicate with one another and with the throughflow passages.

12. Process according to claim 10, characterised in that the soluble particles are pressed into the plastic layer (5, 6) at a temperature at which the plastic layer (5, 6), as compared with its condition at room temperature, is softened.

13. Process according to claim 12, characterised in that the soluble particles are applied and pressed in, after the formation of the plastics layer (5, 6), while its temperature is still elevated.

14. Process according to claim 10, characterised in that the soluble particles have a mean diameter of from 5 to 100 $\mu$m.

15. Process according to claim 10, characterised in that the soluble corpuscles and the soluble particles are composed of the same material.

16. Process according to claim 1, characterized in that the soluble corpuscles comprise inorganic substances.

17. Process according to claim 16, characterized in that the inorganic substances are selected from the group consisting of NaCl, KCl and $CaCO_3$.

18. Process according to claim 1, characterised in that organic substances or salts of organic acids are employed as the soluble corpuscles.

19. Process according to claim 1, characterised in that an anti-oxidant is added to the plastic powder.

20. Process according to claim 1, characterized in that the soluble corpuscles comprise at least two substances, one of the substances being leachable by a solvent in relation to which the respective other substance(s) is/are stable relative to the solvent.

21. Process according to claim 1, characterized in that a second plastic layer (6) with throughflow passages is formed on the support along a side opposite to the side having said first mentioned plastic layer.

22. Process according to claim 21, characterised in that the number of soluble corpuscles in the second plastic layer (6) increases in a direction facing away from the support.

23. Process according to claim 21, characterised in that the size of the soluble corpuscles in the second plastic layer (6) increases in a direction facing away from the support (2).

24. Process according to claim 21, characterised in that the number and/or size of the soluble corpuscles in the regions of both plastic layers (5, 6), where they adjoin the support (2), are the same.

25. Process according to claim 21, characterised in that a support (2) is used which is a textile support formed at least in part of filaments.

26. Process according to claim 25, characterised in that, as the textile support, a non-woven filament web, a knitted, worsted and/or woven web and/or a combination of textile supports is used.

27. Process according to claim 1, characterised in that a support is used formed at least in part by a spun bonded fibre fleece and/or a pressed or extruded reticulated structure.

28. Process according to claim 1, characterised in that the support includes a fibre fleece.

29. Process according to claim 1, characterised in that polyamide, polyester, polypropylene sulphide, polyetheretherketone, polyurethane, polysylfonene, polyphthalamide and/or polypropylene is used for the plastic layer (5, 6).

30. Process according to claim 1, characterized in that a mixture of plastic materials is used for the plastic layer (5, 6), the plastic materials having different elasticities.

31. Process according to claim 1, characterised in that the plastic layer (5, 6) is produced from layers of plastics materials of different elasticities.

32. Process for manufacturing a permeable strip material, comprising the steps of:

a) providing a mixture comprising plastic powder and soluble corpuscles;

b) providing a support;

c) applying the mixture to at least one side of the support and through application of heat and pressure thereby forming a plastic layer, said pressure being sufficient to form a planar outer surface of the plastic layer; and d) leaching the soluble corpuscles from the plastic layer by application of a solvent to which the plastic layer is stable and thereby forming throughflow passages through the plastic layer from one side to another sufficient to permit dewatering to occur.

* * * * *